United States Patent [19]

Ho

[11] 4,305,223

[45] Dec. 15, 1981

[54] MAGIC EYEBALL

[76] Inventor: Teng S. Ho, 6, Lane 153, Chin Hsing Rd., Taipei, Taiwan

[21] Appl. No.: 93,598

[22] Filed: Nov. 13, 1979

[51] Int. Cl.[3] ..... A63H 33/26

[52] U.S. Cl. ..... 46/228; 46/165; 40/444

[58] Field of Search ..... 46/228, 229, 227, 226, 46/165; 362/800; 40/442, 444; 340/762, 782

[56] References Cited

U.S. PATENT DOCUMENTS

| | | | |
|---|---|---|---|
| 3,812,614 | 5/1974 | Harrington | 46/228 |
| 4,055,014 | 10/1977 | Schmidt et al. | 40/442 |
| 4,112,424 | 9/1978 | Lapeyre | 340/762 X |

FOREIGN PATENT DOCUMENTS

| | | | |
|---|---|---|---|
| 520976 | 1/1956 | Canada | 46/228 |
| 778438 | 7/1957 | United Kingdom | 46/228 |

*Primary Examiner*—Gene Mancene
*Assistant Examiner*—Mickey Yu

[57] ABSTRACT

The present invention relates to an illuminated eyeball for toys which comprises a plurality of light emitting diodes (LED), a power apparatus for supplying electrical power to said plurality of light emitting diodes and a plurality of switches which placed under the suitable parts of a plaything's body. By means of the touch or switch of the abovementioned switches, the light emission diodes can emit changeable light.

5 Claims, 4 Drawing Figures

MAGIC EYEBALL

BACKGROUND OF THE INVENTION

1. Field of the Invention

The present invention relates to a magic eyeball for use in a toy or plaything. The magic eyeball has a plurality of light emitting diodes which can emit changable colored light by means of touch or applied force on suitable parts of the plaything's body.

2. Brief Description of the Prior Art

Conventional eyeballs of playthings or toys usually employing a painted ball or an electric bulb are unchangable. This sort of eyeball makes playthings or toys have a blank face.

BRIEF SUMMARY OF THE INVENTION

It is the main object of the present invention to provide a novel eyeball of a plaything or toy which can emit different colored light by different conditions the plaything or toy has undergone.

The second object of the present invention is to provide an eyeball of a plaything or toy so that the plaything or toy can emit colorful light and have an expressive face.

Another object of the present invention is to provide a magic eyeball for a plaything or toy so that the plaything or toy can be more interesting.

According to the present invention, the magic eyebell comprises a plurality of light emitting diodes, together with a power apparatus for supplying electrical power to said plurality of light emitting diodes and a plurality of switches placed under the suitable parts of the plaything's body, wherein the plurality of light emitting diodes comprises several color groups such as a yellow group, a red group, a green and other, and said plurality of switches may comprise on-off switches, magnetic switches and many kinds of touch control switches whose actuation is different from one another. A certain group of light emitting diodes is controlled by one or more certain groups of touch control switches which can make a circuit on or off and energize or deenergize a certain group of relays.

BRIEF DESCRIPTION OF THE DRAWINGS

Those and other objects, features and advantages of the present invention will become apparent from the following detailed description of the preferred embodiment with reference to the accompanying drawings.

DETAILED DESCRIPTION OF THE PREFERRED EMBODIMENT

Figure 1:
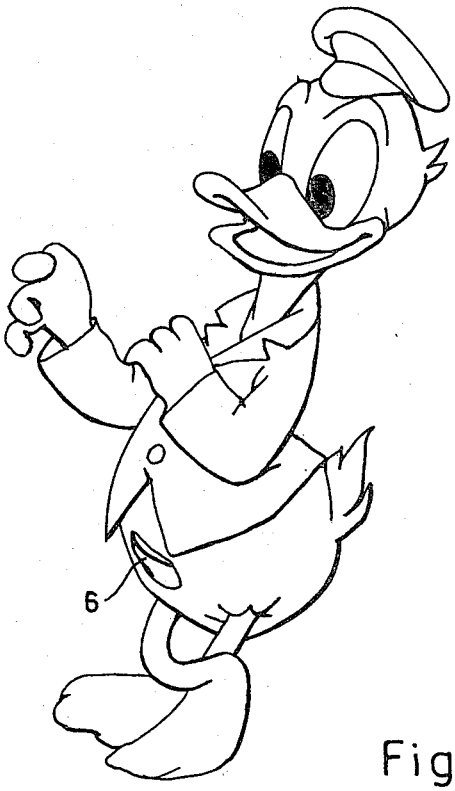
FIG.1 is a whole perspective view of an example employing the magic eyeball according to the present invention.
Figure 2:
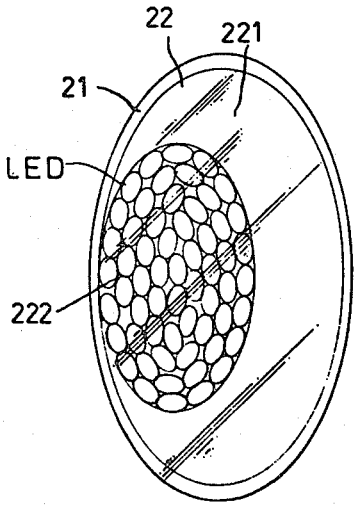
FIG. 2 is a perspective view of the magic eyeball according to the present invention.

Referring to FIG. 1 which shows a perspective view of an example - toy incorporating the present invention and with referrences to FIG. 2, any eyeball of the toy comprises a transparent shield 21 and an eyeball 22 which composes the white of eyes 221 and a pupil 222, and which is inside said shield 21, said pupil 222 being constructed of several types of light emitting diodes (LED) which are arranged together and formed a circle like a pupil.

Figure 3:
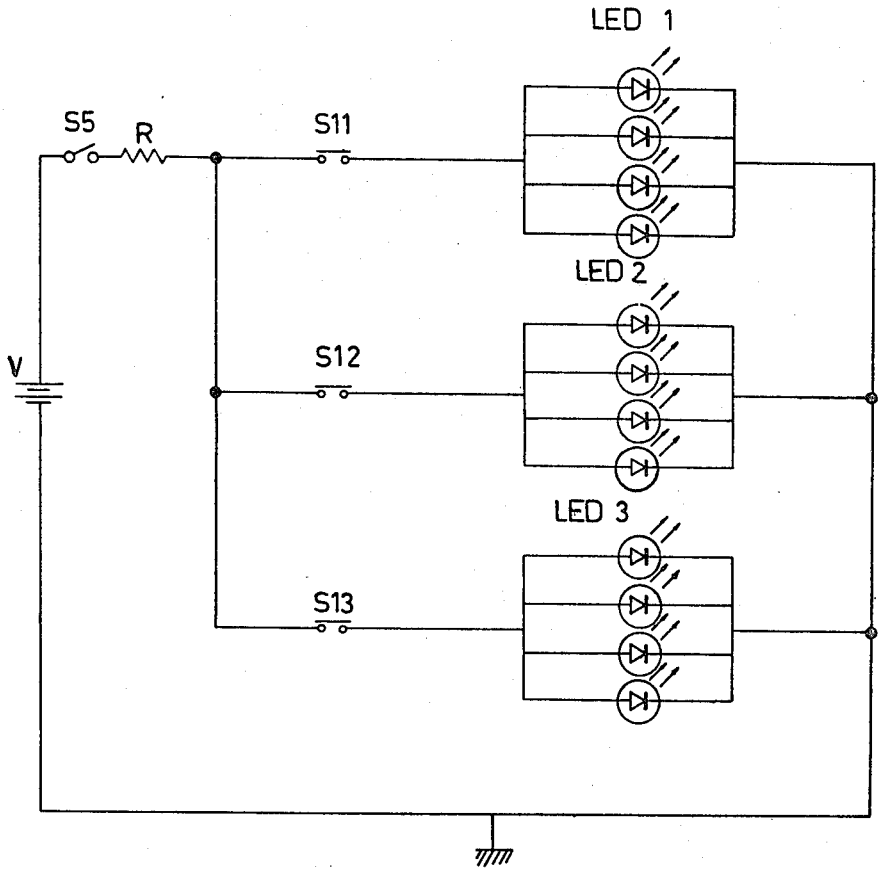
FIG. 3 is a partial network of the electrical circuit of the magic eyeball according to the present invention.
Figure 4:
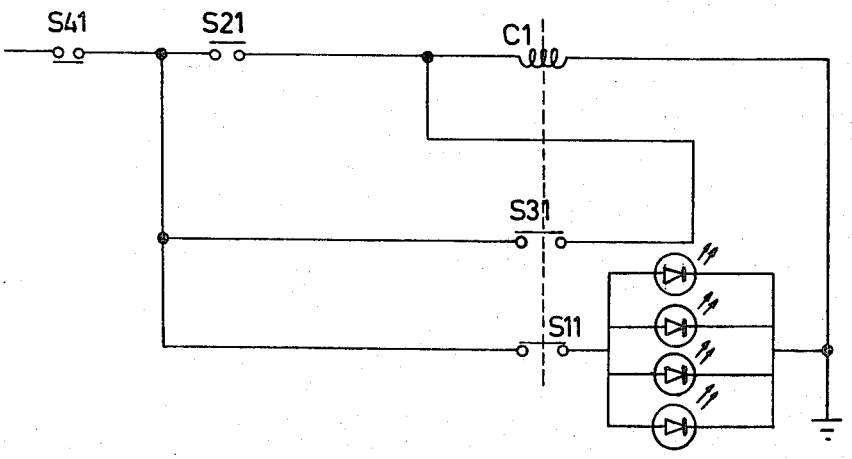
FIG. 4 is the other partial network of the electrical circuit of the magic eyeball according to the present invention.

Referring to FIGS. 3 and 4 which are exemplary network diagrams of the electrical circuit for control of the magic eyeball, light emitting diodes are seen to comprise several groups such as LED1, LED2, LED3 etc. which may be of different color in each group, arranged with the on-off switch S5, the touch control switches S41, S21, the relay contacts S11, S12, S13, S31 and the resistor R, the battery V, to form a network or circuit. Each of the indicated touch control switches may in practice include multiple switches in parallel. When the on-off switch S5 is on, the power will be supplied to the network from the battery V. The relay contact S11 will be energized if the touch control switch S21 (or one or more of the touch control switches S21) undergoes a (or undergo several) proper touch(es), strike(s), or bend force(s) and moves switch S21 to the position of "on".

The touch control switches may be placed under the soft surfaces of any of the certain positions of the plaything's body for example the summit of the head, the knee, or the calf. When one of the certain position is touched or stricken by a proper force, the touch control switch will be actuated.

Generally speaking, red hints of anger, yellow hints of depression and, green hints of happiness. The touch control switch S21 which can make the light emitting diodes LED1 emit the red light would switch on only as the stricken force is over than a certain strength and makes the plaything or toy angry.

C1 is the solenoid of the relay contact S11. When C1 is energized the relay contact S31 on the auxiliary circuit will close and keep C1 in the energized condition. Therefore, anger can remain until one of another group of normal-on-type switches such as S41 is touched, whereupon C1 is deenergized and the light emitting diode LED1 will be switched off. Switch S41 may be placed at the summit of the head or other proper position of the plaything's body. S41 is connected to the main circuit at S5 to provide relay current.

The operation of other LED groups the LED2, LED3 in FIG. 3 is like that of the abovementioned LED1, but they may emit different color by different force of touch, strike or bend on different position of plaything's body and may be controlled by additional relays.

What is claimed is:

1. An illuminated eyeball for use in a toy, comprising: a plurality of light emitting diodes, arranged within a circular outline of the pupil of an eye of the toy; electrical switch means; and an electrical power supply, said power supply being connected to said diodes through said switch means, whereby said diodes may be caused to emit light by activation of said switch means, and wherein: said diodes are arranged in groups with each group comprising a plurality of light emitting diodes of a color different than the other groups; and said electrical switch means includes a plurality of individual switch means, each arranged at a different part of the body of the toy, for activating a corresponding group of diodes, whereby operating any said individual switch means activates a prescribed color group of diodes to create a corresponding psychological mood for the toy.

2. An illuminated eyeball for use in a toy, as claimed in claim 1, further comprising a base and a transparent shield, wherein said base is white in color and forms the exposed white of the eyeball, said plurality of light emitting diodes forming the pupil of the eyeball being mounted on said base, said transparent shield being mounted over said eyeball.

3. An illuminated eyeball for use in a toy, comprising: a plurality of light emitting diodes, arranged within a circular outline of the pupil of an eye of the toy; electrical switch means; and an electrical power supply, said power supply being connected to said diodes through said switching means, whereby said diodes may be caused to emit light by activation of said switch means, and wherein: said plurality of light emitting diodes includes at least two groups of diodes, each of said groups consisting of diodes emitting light of a different color from the emission of the other groups; said electrical switch means includes switch means for each of said groups, whereby each of said color groups may be activated independently of the other of said groups; and said electrical switch means for at least one said color group further includes a plurality of switches placed at separate locations on the body of said toy, and wherein individual switches differ in the force required for switch actuation.

4. An illuminated eyeball for use in a toy, comprising: a plurality of light emitting diodes, arranged within a circular outline of the pupil of an eye of the toy; electrical switch means; and an electrical power supply, said power supply being connected to said diodes through said switching means, whereby said diodes may be caused to emit light by activation of said switch means, and wherein: said plurality of light emitting diodes includes at least two groups of diodes, each of said groups consisting of diodes emitting light of a different color from the emission of the other groups; said electrical switch means includes switch means for each of said groups, whereby each of said color groups may be activated independently of the other said groups; and the energizing force for at least one said electrical switch means for each of said color groups is different from the energizing force required for the switch means for said other groups.

5. An illuminated eyeball for use in a toy, comprising: a plurality of light emitting diodes, arranged within a circular outline of the pupil of an eye of the toy; electrical switch means; and an electrical power supply, said power supply being connected to said diodes through said switching means, whereby said diodes may be caused to emit light by activation of said switch means, and wherein: said switch means further comprises a solenoid-operated relay and at least two switches, said relay being connected to energize said light emitting diodes upon closure of a contact of the relay; at least one of said switches is connected in a relay holding circuit, whereby closure of a relay contact in series with said switch provides holding current to the solenoid of said relay; and at least one of said switches is connected directly between said electrical power supply and the solenoid of said relay.

* * * * *